US006848626B2

(12) United States Patent
McCoy et al.

(10) Patent No.: US 6,848,626 B2
(45) **Date of Patent: *Feb. 1, 2005**

(54) END OF VALVE MOTION DETECTION FOR A SPOOL CONTROL VALVE

(75) Inventors: John Curtis McCoy, deceased, late of Fayetteville, TN (US); by Mary B. McCoy, legal representative, Fayetteville, TN (US); Larry Hiltunen, Rochester Hills, MI (US); Simon Makar, Shelby Township, MI (US); Rafael Cobas-Asensio, Jalisco (MX); Jason Mucha, Shelby Township, MI (US); Changhong Zhang, Rochester Hills, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 221 days.

This patent is subject to a terminal disclaimer.

(21) Appl. No.: 10/095,805

(22) Filed: Mar. 12, 2002

(65) Prior Publication Data

US 2002/0130192 A1 Sep. 19, 2002

Related U.S. Application Data

(60) Provisional application No. 60/278,223, filed on Mar. 23, 2001, and provisional application No. 60/276,220, filed on Mar. 15, 2001.

(51) Int. Cl.[7] ..... F02D 1/06

(52) U.S. Cl. ..... 239/5; 239/585.1; 239/88; 239/96; 137/544; 324/207.2

(58) Field of Search ..... 239/585.1, 585.5, 239/88, 90, 92, 96, 5; 123/446, 467; 137/544; 324/207.2

(56) References Cited

U.S. PATENT DOCUMENTS

| | | | | |
|---|---|---|---|---|
| 5,433,109 A | | 7/1995 | Mayer-Dick et al. | |
| 5,720,261 A | * | 2/1998 | Sturman et al. | 123/446 |
| 5,829,396 A | * | 11/1998 | Sturman | 123/90.12 |
| 5,954,030 A | | 9/1999 | Sturman et al. | |
| 6,053,421 A | | 4/2000 | Chockley | |
| 6,105,616 A | * | 8/2000 | Sturman et al. | 137/625.65 |
| 6,120,005 A | | 9/2000 | Wright | |

FOREIGN PATENT DOCUMENTS

WO WO 9413991 6/1994

OTHER PUBLICATIONS

PCT International Search Report for Application No. PCT/US02/07796 dated Jul. 2, 2002.

* cited by examiner

*Primary Examiner*—Dinh Q. Nguyen

(57) ABSTRACT

A fuel injector system (10) calculates a first derivative filtered signal and a second derivative filtered signal from an unpowered spool valve coil signal. When the spool valve (16) reaches the end of travel, either open or closed position, a flat slope f is generated on the falling edge of the bell shaped signal. The second derivative provides a readily apparent determination of when the steep slope occurs. A comparator (62) thereby need only determine when the second derivative is zero to identify that the spool valve has reached the end of travel.

11 Claims, 2 Drawing Sheets

END OF VALVE MOTION DETECTION FOR A SPOOL CONTROL VALVE

The present application claims priority to U.S. Provisional Patent Application Ser. No. 60/276,220, filed Mar. 15, 2001 and U.S. Provisional Patent Application Ser. No. 60/278,223, filed Mar. 23, 2001.

BACKGROUND OF THE INVENTION

The present invention relates to a fuel injector system, and more particularly to a method of determining the end of motion of a fuel injector spool control valve.

Fuel injectors typically use a high pressure fluid acting on a relatively large area intensifier piston to compress fuel under a smaller area plunger. When fuel pressure is raised above a valve opening pressure, a needle check valve lifts to open the nozzle outlet, and fuel sprays into the combustion space within an engine.

To accurately control the timing of each injection event, the fuel injectors commonly include a solenoid actuated spool valve that opens and closes the fuel injector to the high pressure actuation fluid. The spool valve is essentially an armature movable relative to a solenoid coil located at each axial end of the spool valve.

Each injection event is initiated by energizing one coil to move the control valve to an open position, and each injection event is ended by actuating a second solenoid coil opposite the first coil to move the spool valve back to its closed position. The fluid-actuated fuel injector de-couples the injection quantity and timing from the operation of the engine to provide flexibility of main pilot fuel quantity, timing, and duration.

As the spool valve moves toward the actuated coil, the magnetic field within the unpowered coil varies, thereby producing an opposing voltage or back emf voltage signal in the unpowered coil. Typically, the back emf voltage signal is examined to determine when the spool has reached its full open or closed position. Control of the injection event through actuation of the coils is thereby effected through a feedback control loop.

Although effective, distinguishing when the spool valve has reached the end of travel through examination of the back emf may be difficult and relatively imprecise due to the extremely small timing envelope of an injection event. Moreover, end of travel determinations is further complicated due to dragging of the spool valve, otherwise known as "stiction" which may alter the back emf signal.

Accordingly, it is desirable to provide a method of reliably determining when a fuel injector spool control valve reaches the end of motion.

SUMMARY OF THE INVENTION

The fuel injector system according to the present invention measures a back emf signal from an unpowered spool valve coil. A first derivative filtered signal and a second derivative filtered signal are then calculated from the measured signal. When the spool valve reaches the end of travel, either open or closed position, a flat slope is generated on the falling edge of the measured signal. However, determining exactly when this steep slope occurs is rather difficult when so examining the back emf signal directly considering the extremely small timing envelope of an injection event window and the constant slope change of the signal. By calculating the second derivative, however, the steep slope is readily apparent when the second derivative crosses zero. A comparator thereby need only determine when the second derivative is zero to identify that the spool valve has reached the end of travel.

The present invention therefore provides a method of reliably determining when a fuel injector spool control valve reaches the end of motion.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
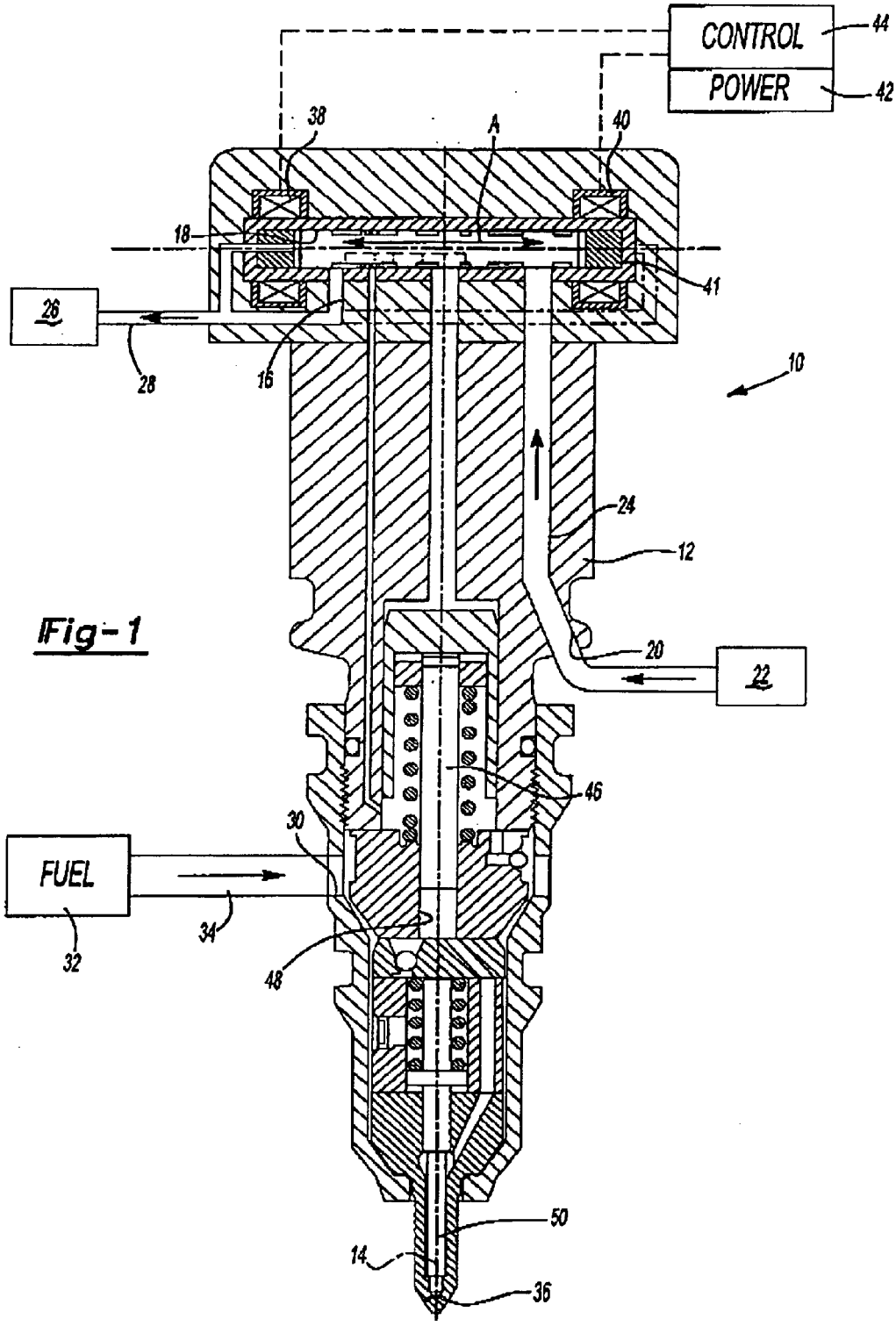
FIG. 1 is a general perspective view fuel injector system for use with the present invention.

FIG. 1 illustrates a general perspective view of a fuel injector system 10. The fuel injector includes an injector body 12 which defines an injector axis 14. An electrically controlled spool valve 18 is movable (as schematically illustrated by arrow A) within the injector body 12 along a spool axis A defined substantially perpendicular to the injector axis 14. The injector body 12 defines an actuation fluid inlet 20 which communicates with a high pressure actuation fluid source 22 via an actuation fluid supply passage 24. An actuation fluid drain 16 communicates with a low pressure return reservoir 26 via a drain passage 28. Injector body 12 also defines a fuel inlet 30 which communicates with fuel source 32 through a fuel supply passage 34 such that fuel from the fuel source 32 is directed through a nozzle outlet 36 that is preferably appropriately positioned within the combustion space of an internal combustion engine.

A first and second opposed electric coil 38, 40 are mounted at each end of the electrically controlled spool valve 16. Each coil 38, 40 is connected to a power source (illustrated schematically at 42) and a controller (illustrated schematically at 44). The electrically controlled spool valve 16 is attracted to the coil 38, 40 which is selectively energized by the power source 42. Concurrently, the controller 44 measures a signal (FIG. 3) generated within the inactive coil 40, 38.

As generally known, when a coil 38, 40 is energized, the spool valve 16 begins moving toward the energized coil 38, 40. A stop 41 or the like is preferably located at each end of the spool valve 16. To initiate an injection, the spool valve 18 is moved to a first position in which the fluid supply passage 24 is opened and high pressure actuation fluid acts upon an intensifier piston (illustrated schematically at 46), and begins moving it toward a fuel pressurization chamber (illustrated schematically at 48). Fuel pressurization chamber 48 receives fuel from the fuel source 32 through fuel supply passage 34. Piston 46 increases pressure within the fuel pressurization chamber 48 until the pressure rises to a level which opens a needle valve member (illustrated schematically at 50) and fuel is sprayed thorough the nozzle outlet 36.

Figure 2:
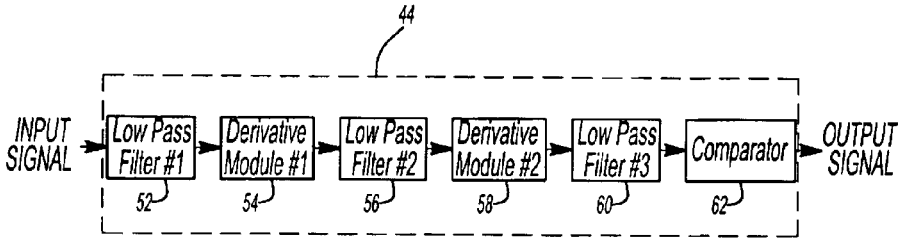
FIG. 2 is a block diagram of the controller of the present invention.
Figure 3:
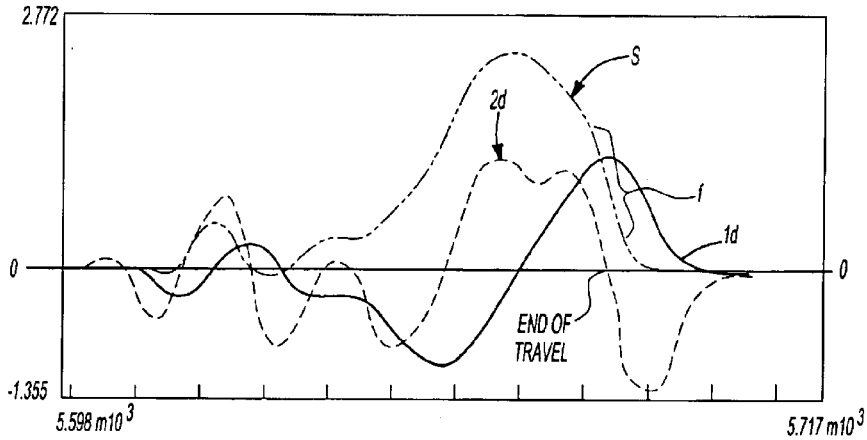
FIG. 3 is a schematic representation of a measured signal derivatives thereof as determined by the controller.

Referring to FIG. 2, the controller 44 is schematically illustrated. The input signal is preferably a voltage measured at the inactive coil 38, 40 (FIG. 1) while the other coil 40, 38 is powered. When the spool valve 16 is in motion, the motion generates a bell shaped voltage curve (FIG. 3) on the inactive coil 38, 40. Preferably, a first filter (illustrated schematically at 52) filters the noise from the signal. The filtered signal (s; FIG. 3) from filter 52 is then used as an input to a first derivative circuit 54 which takes the derivative of the filtered circuit with respect to time to obtain a first derivative signal. As taking the derivative tends to increase as the signal frequency increases and because the inherent circuit noise tends to be of a higher frequencies, the first derivative signal is fed to a second filter 56. The first derivative filtered signal (1*d*; FIG. 3) from filter 56 is then used as an input to a second derivative circuit 58 which takes the second derivative with respect to time to obtain a second derivative signal. The second derivative signal is then passed through a third filter 60 to obtain a filtered second derivative signal (2*d*; FIG. 3). The filtered second derivative signal 2*d* is then compared to a reference by a comparator 62. It should be understood that the filters are preferably, low pass filters which minimize the noise in each signal to provide maximum clarity in the second derivate signal.

Referring to FIG. 3, the filtered signal s, the first derivative filtered signal 1*d* and the second derivative filtered signal 2*d* are graphed relative to a reference which is preferably zero. When the spool valve 18 (FIG. 1) reaches the end of travel, either open or closed position, a flat slope (illustrated generally at f) is generated on the falling edge of the bell shaped signal s. Identification of the steep slope in the back emf determines when spool motion ends as the spool valve's velocity rapidly falls off. It is known to determine the falling edge of the bell shaped signal s by appropriate signal identification software and/or circuitry. However, determining exactly when this steep slope occurs is rather difficult when so examining the back emf signal directly considering the extremely small timing envelope of an injection event window and the constant slope change of the signal. By calculating the second derivative 2*d*, however, the steep slope is readily apparent when the second derivative 2*d* crosses zero. The comparator 62 thereby need only determine when the second derivative is zero to identify that the spool valve 18 has reached the end of travel.

Furthermore, it still is worth stating that the present invention is not limited to a microprocessor based control system. The system may be implemented in a non-microprocessor based electronic system (either digital or analog).

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of controlling an electrically spool valve comprising the steps of:

(1) energizing a first coil to move a spool valve;

(2) measuring a signal at en unpowered coil;

(3) determining a second derivative signal with respect to time of the signal measured in said step (2); and (4) comparing the second derivative signal from said step (3) with a reference to determine a position of the spool valve.

2. A method as recited in claim 1, wherein the reference of said step (4) is zero.

3. A method as recited in claim 1, wherein the signal is a voltage.

4. A method as recited in claim 1, further comprising the step of filtering the signal after said step (2) to obtain a first filtered signal.

5. A method as recited in claim 1 wherein said step (3) further comprises:

determining a first derivative signal with respect to time of the signal measured in said step (2);

filtering the first derivative signal to obtain a filtered first derivative signal;

determining the second derivative signal from the first filtered derivative signal; and filtering the second derivative signal prior to said step (4).

6. A method of injecting fuel comprising the steps of:

(1) providing a fuel to a spool valve movable between a first and a second coil such that the spool valve selectively provides fuel flow to a fuel injector when the spool valve is located in a first position and prevents fuel flow to the fuel injector in a second position;

(2) energizing the first coil to attract the spool valve;

(3) measuring a signal at the second coil, the second coil being unpowered;

(4) determining a second derivative of the signal measured in said step (3); and (5) comparing the second derivative signal from said step (4) with a reference to determine an end of travel position of the spool valve.

7. A method as recited in claim 6, wherein the reference of said step (5) is zero.

8. A method as recited in claim 6, wherein the signal is a voltage.

9. A method as recited in claim 6, further comprising the step of filtering the signal after said step (2) to obtain a first filtered signal.

10. A fuel injector system comprising:

a fuel injector;

an electrically controlled spool valve movable between a first and a second coil such that the spool valve selectively provides a fuel flow to the fuel injector when the spool valve is located in a first position and prevents the fuel flow to the fuel injector in a second position;

a sensor to measure a signal at a first coil while said first coil is unpowered and said second coil is powered;

a derivative circuit to determining a second derivative signal with respect to time of the signal measured by said sensor; and a comparator to compare the second derivative signal with a reference to determine a position of the spool valve.

11. The fuel injector system as recited in claim 10, further comprising a filter to filter said signal.

* * * * *